United States Patent [19]

Pope et al.

[11] Patent Number: 4,941,415

[45] Date of Patent: Jul. 17, 1990

[54] MUNICIPAL WASTE THERMAL OXIDATION SYSTEM

[75] Inventors: G. Michael Pope, Ottumwa; Donald F. Kerr, Burlington, both of Iowa

[73] Assignee: Entech Corporation, Ottumwa, Iowa

[21] Appl. No.: 430,371

[22] Filed: Nov. 2, 1989

[51] Int. Cl.[5] ..... B09B 3/00; F23G 7/00

[52] U.S. Cl. ..... 110/235; 110/211; 110/212; 110/213; 110/214

[58] Field of Search ..... 110/212, 210, 211, 213, 110/214, 235

[56] References Cited

U.S. PATENT DOCUMENTS

| | | | |
|---|---|---|---|
| 3,301,222 | 1/1967 | Tanner | 122/2 |
| 3,511,224 | 8/1968 | Porwancher | 110/213 |
| 3,567,399 | 3/1971 | Altmann et al. | 110/213 |
| 3,643,633 | 2/1972 | Sugano | 122/2 |
| 3,719,171 | 3/1973 | Brooks | 122/2 |
| 4,063,521 | 12/1977 | Pech | 110/213 |
| 4,125,593 | 11/1978 | Scheifley et al. | 423/481 |
| 4,345,529 | 8/1982 | Weber et al. | 110/213 |
| 4,466,359 | 8/1984 | Weber et al. | 110/214 |
| 4,516,511 | 5/1985 | Kuo | 110/346 |
| 4,583,469 | 4/1986 | DiSabatino | 110/210 |
| 4,766,822 | 8/1988 | DeCicco et al. | 110/213 |
| 4,800,824 | 1/1989 | DeFonzo | 110/213 |
| 4,870,910 | 10/1989 | Wright et al. | 110/214 |

*Primary Examiner*—Edward G. Favors
*Assistant Examiner*—Denise L. Ferensic
*Attorney, Agent, or Firm*—Henderson & Sturm

[57] ABSTRACT

An air-starved, batch burn, modular, municipal waste incinerator. It is designed to oxidize unsorted loads of heterogeneous materials in quantities ranging from 5 to 500 tons per 12 to 15 hours. The unique aspect of this system design is that through research in air mixing, air turbulence, and temperature control, it is possible to burn this material with a highly favorable stack emission product, without the need for bag houses, dry scrubbing, or other elaborate down stream air processing equipment. The incinerator includes a primary combustion chamber connected to a secondary combustion unit by a gas transfer tube. Solid material in the primary is oxidized—or gasified—without live flame. This flammable gas stream is vented into the secondary for ignition. Combustion gases from the primary chamber are completely burned in the secondary combustion unit as the gases pass upwardly through the air mixing ring and tangentially disposed re-ignition burners. The tangential orientation of the re-ignition burners forms a vortex of flame through which the combustion gases travel before exiting from the stack.

10 Claims, 3 Drawing Sheets

MUNICIPAL WASTE THERMAL OXIDATION SYSTEM

TECHNICAL FIELD

This invention relates to incinerators, and more particularly to an air-starved, batch burn, modular municipal waste thermal oxidation system.

BACKGROUND ART

Municipal waste is material discarded from residential, commerical, and some industrial establishments. The amount of waste generated in the year 2000 is expected to be in the range of 159 to 287 million tons per year, compared to estimates of current generation rates of 134 to 180 million tons. The most common method currently used to dispose of municipal waste is direct landfill. However, existing landfill capacity is being exhausted in many areas of the country and new landfills are becoming increasingly difficult to site. Because of these problems with direct landfill, increased emphasis will be made on reducing waste volume through combustion.

There are three basic types of facilities used to combust municipal waste. The predominant type is called "mass burn" because the municipal waste is combusted with a priority on consuming large amounts of material through-put. The combustors at mass burn facilities usually have overfeed stroker type grates. These combustors are field erected and individual combustors can range in size from 500 to 3,000 tons per day of municipal waste input. A second type of facility is the modular combustor. Modular combustors are typically shop-fabricated and range in size from 5 to 100 tons per day. A third method for combusting municipal waste is processing it to produce refuse derived fuel (RDF), then combusting the RDF in a waterwall boiler. RDF offers the advantage of producing a more homogeneous fuel and increasing the percentage of municipal waste which is recycled.

Almost all existing facilities have some type of particulate matter emission controls. Many existing modular combustors attempt to control particulate matter using a two-stage combustion process, most of these facilities also have add-on controls. Other facilities use add-on controls, such as ESPs, dry scrubbers, wet scrubbers, and baghouses. Almost all new facilities will have add-on particulate controls such as ESPs and baghouses. In addition, a significant number may include acid gas controls. However, total emissions from MWC are still expected to increase due to the large increase in the total capacity of the population.

Those concerned with these and other problems recognize the need for an improved municipal waste incinerator.

DISCLOSURE OF THE INVENTION

The present invention provides an air-starved, batch burn, modular, municipal waste incinerator. It is designed to burn unsorted loads of heterogeneous materials in quantities ranging from 5 to 1,000 tons per standard eight hour day. The unique aspect of this system design is that through research in air mixing, air turbulence, and temperature control, it is impossible to burn this material with a highly favorable stack emission product, without the need for bag houses, dry scrubbing, or other elaborate down stream air processing equipment. The thermal oxidation system includes a primary oxidation chamber connected to a secondary combustion unit by a gas transfer tube. Flammable gases created in the primary chamber are completely burned in the secondary combustion unit. The gases pass upwardly through the air mixing ring and tangentially disposed re-ignition burners. The tangential orientation of the re-ignition burners forms pilot flame through which the combustion gases travel before exiting from the stack. The ceramic cup immediately above the pilot flame creates a high temperature environment and entrains the gas stream for up to 5.5 seconds. Both the temperature and dwell time are adjustable by the system process controller.

An object of the present invention is the provision of an improved municipal waste incinerator.

Another object is to provide a municipal waste incinerator that is simple in design and durable and economical to supply.

A further object of the invention is the provision of a municipal waste incinerator that can be efficiently and safely operated without sophisticated engineering or managerial support.

Still another object is to provide a municipal waste incinerator that has a rapid process cycle, thus minimizing problems of inset and rodent infestation, odors and scattering of trash.

A still further object of the present invention is the provision of a municipal waste incinerator that minimizes the adverse impact on the environment by producing a clean stack air emission product and by providing for recovery of recyclable glass chard, ferrous and non-ferrous metals, and ash residue for use as number one concrete aggregate, asphalt additive, or inert fill material.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
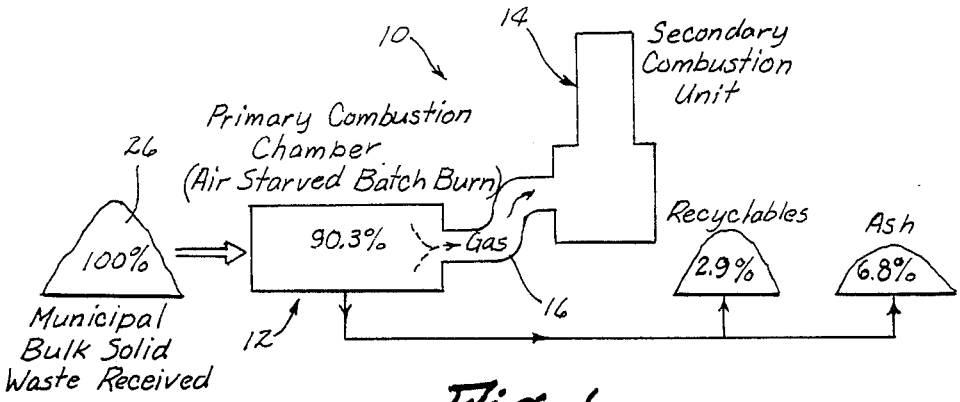
FIG. 1 is a schematic flow diagram illustrating typical inputs and outputs of the municipal waste incinerator of the present invention
Figure 2:
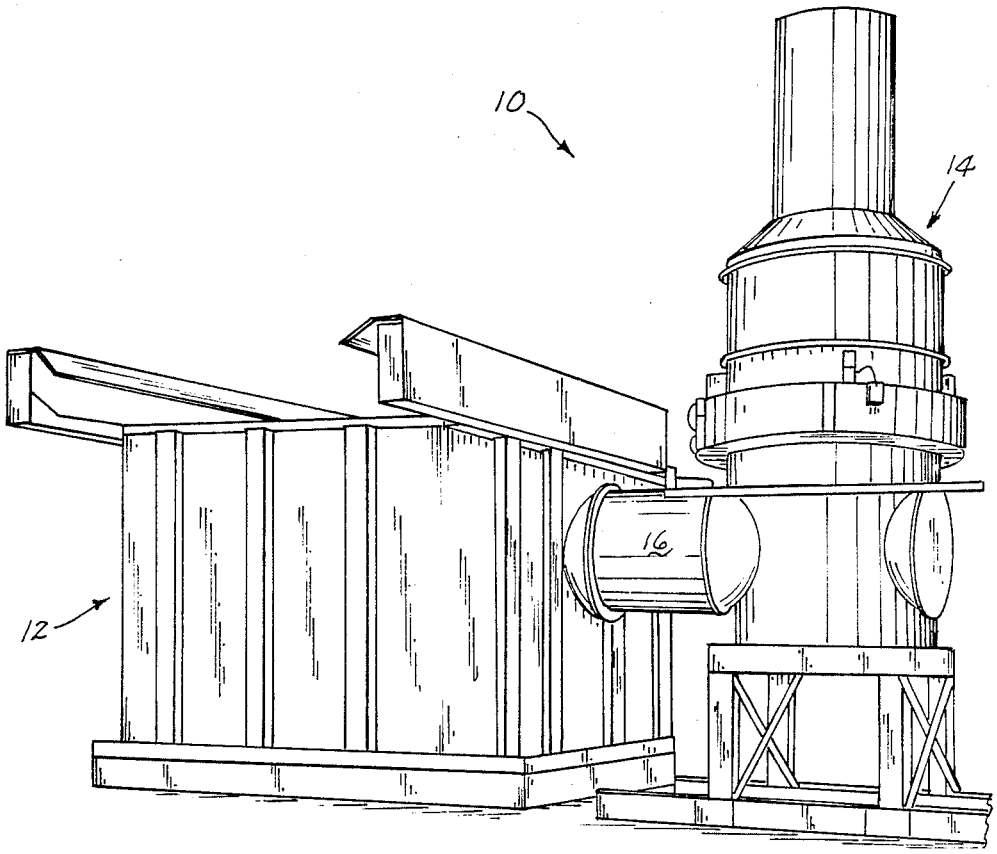
FIG. 2 is a perspective view showing the exterior of one possible embodiment of the incinerator wherein the primary combustion chamber is connected to the secondary combustion unit by the gas transfer tube.

Referring now to the drawings, wherein like reference numerals designate identical or corresponding parts throughput the several views, FIGS. 1 and 2 show a municipal waste incinerator (10) including a primary combustion chamber (12) and a secondary combustion unit (14) interconnected by a gas transfer tube (16).

Figure 3:
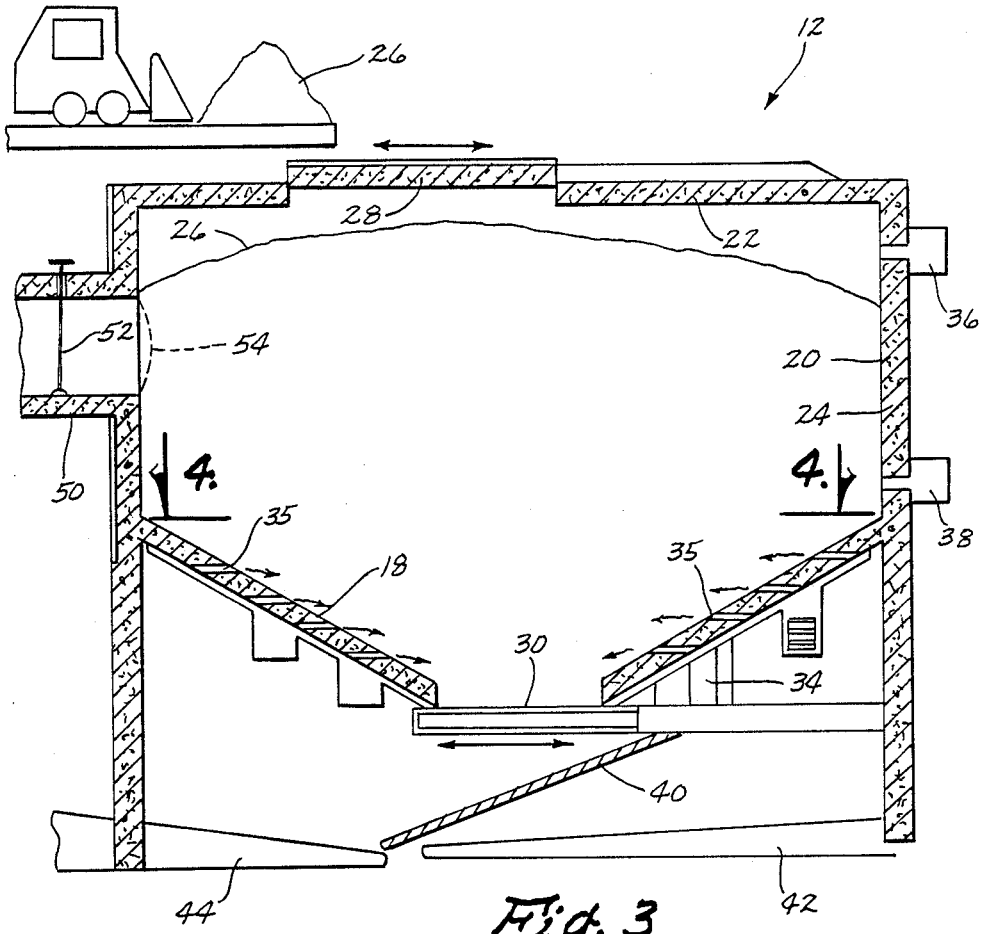
FIG. 3 is a sectional elevation view of the primary combustion chamber.
Figure 4:
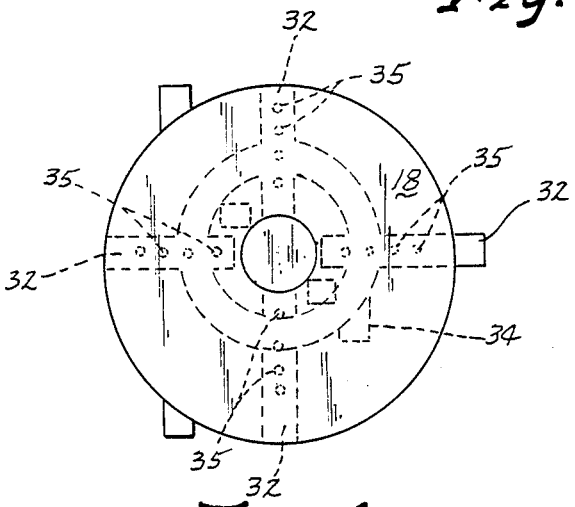
FIG. 4 is a sectional plan view of the primary combustion chamber taken along 4—4 of FIG. 3 showing the floor mounted combustion air supply lines.

As best shown in FIGS. 3 and 4, the primary combustion units or pods (12) are all of identical construction; however, to accommodate different volumes, they may be supplied in different sizes. They are a panel steel fabrication for the floor (18), walls (20), and top (22), with six inches of A. P. Green refractory lining (24) on all interior surfaces. The panels are on-site assembled. Waste material (26) is ignited and combusted in this chamber (12) after being batch loaded to the approximate level shown in FIG. 3.

Depending on the size of the pod (12), there are one, two, three or four access doors (28) in top (22) for loading waste materials (26). The doors (28) may be hydraulically operated, and are refractory lined steel fabrications. The door closing sequence may be automatic with safety and manual overrides. When fully closed, the door's weight mechanically seals the door against a spun glass barrier (not shown) to prevent the escape of gas during the combustion process. The door (28) is not physically latched into place, providing explosion relief in the unlikely event that any significant amount of explosive material would be placed in the chamber.

Other access to the primary combustion unit (12) is provided for the removal of non-combustible material, such as steel, glass, plaster, etc. These doors (30) are similar in construction to the top access panels (28) and are part of the side panel fabrications. These doors (30) and those doors (28) in the top of the pod (12) must be fully closed before the ignition process can begin. This function is controlled automatically through the central operations control room (not shown).

Combustion air is introduced into the pod (12) through a series of floor mounted stainless steel supply lines (32). Each supply line (32) includes a number of horizontal or downwardly directed ports (35) which supply air to the pod (12). Since the ports (35) are horizontal or downwardly directed they do not fill with material and become plugged. The lines (32) are connected to an air compressor (34) which feeds additional air into the pod (12) as dictated by the combustion activity. Upper ignition burners (36) and lower ignition burners (38) are spaced around the walls (20), Air additions or restrictions are regulated by computer in the central operations room.

Upon completion of the burn, a fine ash powder and larger pieces of steel, glass, and rock are left in the pod (12). The clean out access door (30) is opened and the uncombusted material drops down on screen (40). Fines or ash fall through the screen (40) to the fines conveyor (42) and larger size material is removed by the sorting conveyor (44).

A large diameter connection transfer tube (50) diverts gas formed during primary combustion into the secondary combustion unit (14). The tube (50) is a cylindrical steel fabrication with six inches of refractory lining (24). There is a steel damper (52) in the center of this tube. The damper (52) is electronically or manually operated and is used to control air flow from the primary unit (12) to the secondary unit (14) for the purpose of regulating combustion activity. A cage (54) covers the opening where the tube (50) connects to the primary unit (12).

Once the waste material (26) is loaded, all access doors (28 and 30) to the pod (12) are sealed, and the ignition sequence begins. Propane or natural gas fired Eclipse burners (36 and 38) are used to ignite the material. The duration of the primary ignition burn is determined by the composition of the waste (26), and the internal temperature of the pod (12). This is regulated automatically through the control system. The number of Eclipse igniters (36 and 38) per pod (12) is dependent on the overall pod dimensions such that there is sufficient igniter capacity to evenly ignite the upper surface area of the waste charge (26). The igniters (36 and 38) automatically re-engage if there is still material remaining in the pod (12) and if the internal temperature of the pod (12) falls below 750° F. As the material (26) in the primary combustion unit (12) burns, there is no visible flame. Essentially, the solid material (26) is converted to a gas under temperature. As the gas material is formed, it is vented through the transfer tube (50).

Figure 5:
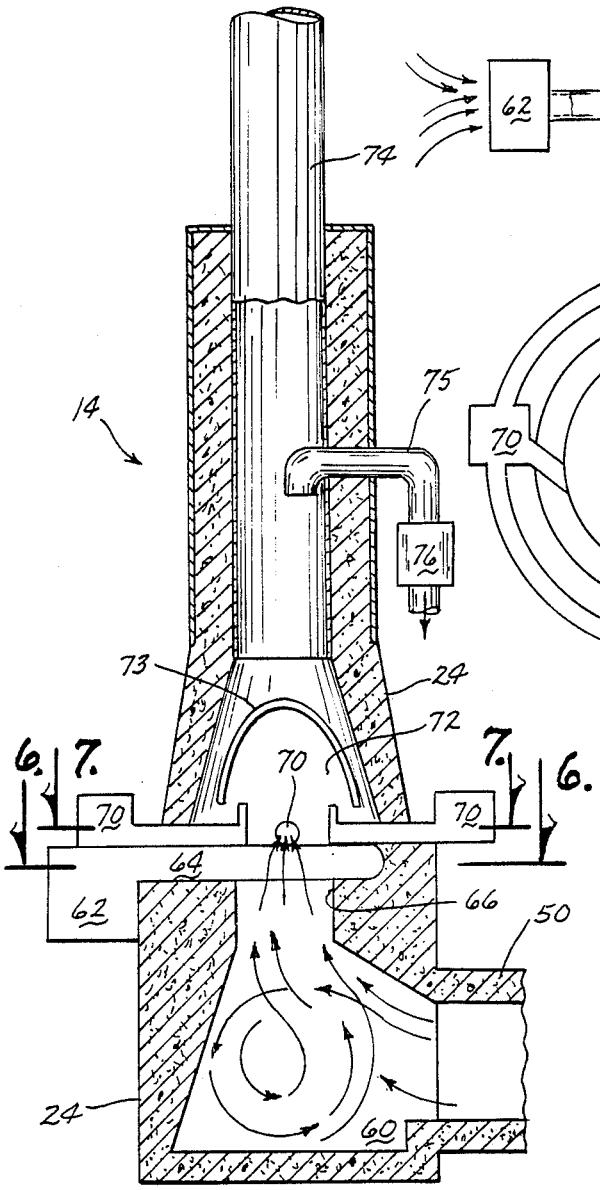
FIG. 5 is a sectional elevational view of the secondary combustion unit.

As most clearly shown in FIG. 5, gas from the primary combustion unit (12) enters into the gas accumulation chamber (60) by the draft created in the higher cells of the secondary combustor (14). This chamber (60) provides a collection point for the fluctuating gas volumes coming from the primary combustion process. This is a steel fabrication with refractory lining (24), as are the other components which were previously discussed.

Figure 6:
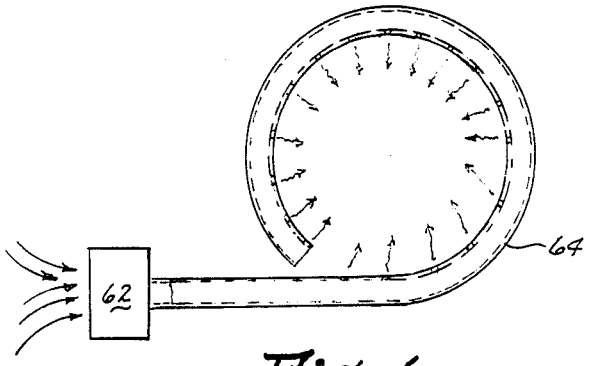
FIG. 6 is a sectional plan view of the secondary combustion unit taken along line 6—6 of FIG. 5 showing the orientation of the air mixing ring.
Figure 7:
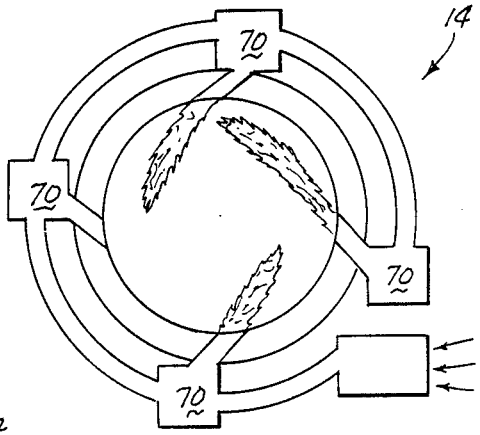
FIG. 7 is a sectional plan view taken along line 7—7 of FIG. 5 showing the orientation of the re-ignition burners positioned immediately above the air mixing ring.

As best shown in FIGS. 5 and 6, outside air is drawn into the system with electric blowers (62) through a steel duct assembly (64) which surrounds the outer casing of the secondary combustor (14). The air is pressurized in this duct (64), and diverted under pressure through a series of 1.5 inch diameter tubes (not shown) imbedded in the choke and air mixing ring (66). This ring (66) is ceramic fabrication 5.5 feet in diameter by 10 inches thick, with an inside diameter of 8.5 inches. The pressurized gas moving through the 8.5 inch diameter throat of the mixing ring mixes with the outside air, this combined air and gas forms an air cone six inches above the ring with a focal point of two inches in diameter.

At the focal point of the air/gas mixture, six inches above the center of the mixing ring (66) four Eclipse ignition burners (70) are located. The four are oriented at 90° degrees, but the force of the flame is directed about 30° degrees off of center to the counter clockwise side. The effect of this positioning is to cause the complete re-ignition of any non-combusted gas in the air stream, and to cause the air stream to rope slightly, and to increase the turbulence of the air column. This improves the air mix, and increases the retention time of the air column in the ignition cell. Outside air is used as propellant for the natural gas or propane burners. This increases the available mixing air volume, and contributes to the "cutting torch" effect of this system.

Following the re-ignition of the gas stream, it enters an ignition cell or expansion chamber (72) to provide controlled residence time at high temperatures. This chamber (72) contains the live flame and provides a high temperature environment for the gas stream. As with other parts of the system, this is a steel fabrication with six inches of refractory lining (24). An inverted ceramic cup (73) is positioned immediately above the burners (70) to create a high temperature environment and entrain the gas stream for up to 5.5 seconds. Both the temperature and the dwell time are adjustable by the system process controller.

Under some conditions where certain materials are being burned, heavy metals and acid formation can re-combine in the air stream after the secondary combustion process. To effectively remove these contaminants when necessary, a wet scrubber can be installed in-line above the expansion chamber (72). To convey the air stream from the building housing the incinerator (10), the stack (74) is mounted on either the wet scrubber or at the exit port of the ignition cell or expansion chamber (72) as the installation dictates. The stack (74) is a double walled 12 gauge steel fabrication, with access ports (not shown) for air sampling at two, four and six diameters of height. Access to the ports is provided on an individual installation basis.

A reflux line (75) including a flow valve and meter (76) extends from the stack (74) and selectively returns a portion of the gas stream to the air supply lines (32) of the primary combustion chamber (12).

In operation, with the bottom door (30) closed and sealed, waste material (26) is loaded into the primary combustion chamber (12) to an approximate level as indicated in FIG. 3. The loading door (28) is then closed and sealed. In secondary unit (14), the blower (62) is activated for about three minutes to purge gas residues to the atmosphere. The re-ignition burners (78) are then activated until the internal temperatures reaches about 500° F. The secondary unit (14) is thus pre-heated to ignite the gas flow that will be coming from the primary unit (12). The top set of ignition burners (36) in the primary unit (12) are then activated and continue to run until the pod temperature reaches 250° F. The damper (52) is opened to allow about ten percent flow through the transfer tube (50).

The temperature in the primary combustion chamber (12) is kept around 250° F. by activating the lower ignition burners (38) and/or providing forced air through the ports (35). The damper (52) is adjusted to provide a flow of gas to the secondary combustion unit (14) at the maximum gas flow rate the secondary unit (14) wil handle while having a favorable stack emission.

To control the quality of stack emissions, the temperature in the expansion chamber is maintained in a range from about 1800° F. This is accomplished by simultaneous control of the damper (52) which regulates the volume of feed gas coming through the transfer tube, the supply of fuel to the re-ignition burners (70), and the electric blowers (62) which regulates the air volume in the air mixing ring (66).

EXAMPLE 1

A series of computer runs were completed where air supplied to the primary combustion unit varied from 125% excess air over stoichoimetric to a 50% deficiency. The calculated flame or combustion temperature varied from 1343° F. at 125% excess air to up to 2224° F. for the stoichiometric air. For the air starved runs, the temperature decreased as the air decreased. At a 50% air deficiency, the calculated temperature in the primary combustion unit was 978° F. These computer runs assume that all of carbon in the garbage is converted to carbon dioxide and carbon monoxide. If there is any unburned carbon in the ash, as there probably will be under air starved conditions, the combustion temperatures will be lower than that predicted by the computer runs.

The gases from the primary combustion were fed to the secondary combustion unit for those runs where the primary combustion unit operated under a deficiency of air (runs 4–21). A pilot flame of natural gas (mostly methane, composition 24.66% hydrogen and 75.34% carbon and heat of combustion of 23011 BTU/lb) was fed to the secondary combustion unit to insure ignition. The natural gas was used as fuel for the secondary combustion unit for the purpose of the computer runs, but the fuel quantity added was set equal. to zero so it would not add to the mass and energy balance. When the secondary combustion unit was operated at 20% excess air, a 2260° F. temperature was achieved. When the air was increased to 125% excess, the temperature in the secondary combustion unit decreased to about 1700° F.

In actuality, when the primary combustion unit is burned with a deficiency of air, considerable soot will form and the ash will likely contain unburned carbon. The result will be less carbon monoxide available to the secondary combustion unit. The secondary combustion unit temperature will therefore be less than that predicted by the computer runs.

The gas detention time in the secondary combustion unit can be calculated from the gas flow (actual cubic feet per minute) and the secondary combustion unit volume (38.9 cubic feet). For a 10000 ACFM flow, the detention time is calculated to be 4.5–5.25 seconds. The detention time required for destruction of products of incomplete destruction is also a function of how well the air, fuel, and off-gases from the primary combustion unit are mixed at the flame.

For runs 13–16, the percent excess air in the pod was varied at a 1815 lbs/hr burn rate until a 1000° F. temperature was achieved. This was calculated to occur at a −40.7% excess air rate. Then, using the −40.7% excess air rate, the resulting temperature at burn rates of 1500, 2000 and 2500 lbs/hr was calculated (Runs 17, 18, and 19). The result was a hotter temperature as the feed rate or burn rate increased. For run 20, it was assumed that 80% of the carbon in the feed would be burned and the rest would remain in the ash. For run 21, it was assumed only 60% of the carbon would be burned. The result of unburned carbon was lower temperatures in the primary and secondary combustion unit.

Table 1, below, summarizes these computer runs.

TABLE 1

| | | Summary of Computer Runs | | | | | |
|---|---|---|---|---|---|---|---|
| | | Primary Combustion Unit | | | Secondary Combustion Unit | | |
| Run | % Ash in feed | % Excess Air | Temp. °F. | Gas Flow ACFM | % Excess Air | Temp. °F. | Gas Flow ACFM |
| 1 | 24.11% | 125 | 1343 | 11952 | — | — | — |
| 2 | 24.11% | 20 | 1953 | 9231 | — | — | — |
| 3 | 24.11% | 0 | 2224 | 8834 | — | — | — |
| 4 | 24.11% | −10 | 1931 | 7362 | 20 | 2262 | 9105 |
| 5 | 24.11% | −20 | 1632 | 5998 | 20 | 2272 | 9286 |
| 6 | 24.11% | −30 | 1359 | 4829 | 20 | 2338 | 9660 |
| 7 | 24.11% | −40 | 1038 | 3661 | 20 | 2375 | 9938 |
| 8 | 24.11% | −50 | 978 | 3160 | 20 | 2378 | 10100 |
| 9 | 24.11% | −50 | 978 | 3160 | 60 | 2034 | 10209 |
| 10 | 24.11% | −50 | 978 | 3160 | 125 | 1733 | 10879 |

TABLE 1-continued

| Summary of Computer Runs | | | | | | | |
|---|---|---|---|---|---|---|---|
| | | Primary Combustion Unit | | | Secondary Combustion Unit | | |
| Run | % Ash in feed | % Excess Air | Temp. °F. | Gas Flow ACFM | % Excess Air | Temp. °F. | Gas Flow ACFM |
| 11 | 35% | −50 | 925 | 2607 | 125 | 1702 | 9190 |
| 12 | 35% | −50 | 925 | 2607 | 20 | 2311 | 8449 |
| 13 | 100% | −43 | 911 | 3263 | 20 | 2366 | 9950 |
| 14 | 100% | −35 | 1217 | 4276 | 20 | 2377 | 9870 |
| 15 | 100% | −41 | 991 | 3515 | 20 | 2366 | 9920 |
| 16 | 100% | −40.7 | 1003 | 3553 | 20 | 2366 | 9917 |
| 17 | 100% | −40.7 | 957 | 2844 | 20 | 2306 | 8021 |
| 18 | 100% | −40.7 | 1022 | 3966 | 20 | 2391 | 11026 |
| 19 | 100% | −40.7 | 1049 | 5048 | 20 | 2433 | 13984 |
| 20 | 80% | −37 | 984 | 3113 | 20 | 2086 | 7527 |
| 21 | 60% | −29 | 976 | 2746 | 20 | 1765 | 5331 |

Feed Rates:
Run 17: 1500 lbs/hr
Run 18: 2000 lbs/hr
Run 19: 2500 lbs/hr
All other runs: 1815 lbs/hr

EXAMPLE 2

Emissions testing was conducted for the following series of test burns in the minicipal waste incineration system prototype.

Test 1=Wood, paper material, cardboard
1. 1,115 pounds raw material weight;
2. Length of burn −8 hours, 7 minutes;
3. Propane fuel consumption=50 gallons;
4. Post-burn ash recovery=30 pounds;
5. Percent reduction by weight=97.31%.

Test 2=Lawn debris, vegetation, hay, apples
1. 888 pounds raw material weight;
2. Length of burn=8 hours, 40 minutes;
3. Propane fuel consumption=130 gallons;
4. Post-burn ash recovery=97 pounds;
5. Percent reduction by weight=89.1.

Test 3=Truck and automobile tires
1. 1,464 pounds raw material weight;
2. Length of burn=8 hours, 7 minutes;
3. Propane fuel consumption=45 gallons;
4. Post-burn ash recovery=247 pounds (118 pounds steel belting, 129 pounds ash);
5. Percent reduction by weight=88.13%.

Test 4=Mixed residential trash (19% plastics by weight)
1. 1,271 pounds raw material weight;
2. Length of burn=7 hours, 55 minutes;
3. Propane consumption=70 gallons;
4. Post-burn ash recovery=79 pounds (52 pounds ash, 15 pounds glass, 6 pounds metal);
5. Percent reduction by weight (total)=93.8%; Percent reduction by weight (ash only)=96.0%.

Summary Data

Total material burned=4,738 pounds;
Average weight per test=1,184.5 pounds;
Average burn time=8 hours, 18 minutes;
Total ash recovery=453 pounds (ash, glass, metals);
Average recovery of ash per burn=113.25;
Percentage reduction by weight=90.44%.

As shown in Tables 2 and 3 below, low levels of particulates and carbon monoxide in the stack gases was impressive. The highest particulate emission measured for any of the burns was 0.17 pounds per hours (2.1 milligrams per standard cubic feet) during the tire burn, and that emission was reduced significantly by proper adjustment of fuel and air to the secondary combustion unit. When the burner controls were adjusted properly, there was no visible stack plume nor noticeable odor.

The $NO_x$ emissions were primarily a function of temperature in the secondary combustion unit. For test burns 3 and 4, the $NO_x$ could be controlled at under 60 parts per million. Sulfur dioxide and chloride emissions were primarily a function of the sulfur content and chloride content of the garbage burned.

Table 4 below, summarizes the trace metal analysis of the stack gas.

TABLE 2

| Stack Emissions (Average of Measurements During Test) | | | | | |
|---|---|---|---|---|---|
| Test | CO ppm | $NO_x$ ppm | $SO_2$ ppm | Chlorides ppm | Particulates mg/SCF |
| 1 | 21 | 42 | not detected | 0.8 | 1.0 |
| 2 | 28 | 51 | not detected | not measured | 1.1 |
| 3 | 33 | 59 | 72 | 5.4 | 1.6 |
| 4 | 26 | 59 | 10 | 21.2 | 0.9 |

Units:
ppm=parts per million by volume;
mg/SCF=milligrams per standard cubic foot of stack gas, dry basis, 70° F. and 1 atm;
Chlorides reported as equivalent HCl, detection limit 0.4 ppm.

TABLE 3

| Particulate Emission Results | | | | | |
|---|---|---|---|---|---|
| Test | Sample | % $H_2O$ | % $CO_2$ | Lbs/Hr | mg/dsf |
| 1 | 1 | 15.4 | 12.100 | 0.068 | 0.81 |
| 2 | 1 | 9.17 | 8.856 | 0.063 | 0.83 |
| 2 | 2 | 7.13 | 6.043 | 0.073 | 0.39 |
| 2 | 3 | 8.68 | 9.648 | 0.098 | 1.27 |
| 3 | 1 | 0.96 | 7.416 | 0.078 | 0.88 |
| 3 | 2 | 8.80 | 6.348 | 0.166 | 2.03 |
| 4 | 1 | 15.18 | 6.616 | 0.0647 | 0.91 |
| 4 | 2 | 9.96 | 5.251 | 0.0641 | 0.79 |
| 4 | 3 | 9.92 | 5.788 | 0.0635 | 0.82 |

Note:
mg/dsf = milligrams particulate per dry standard cubic feet of flue gas;
lbs/hr = pounds per hours of particulate;
% $H_2O$ and % $CO_2$ = actual volumetric percent measured during the tst (averaged value);
Test 2 - Sample 1 = this test discarded due to developed leak in the sampling system.
(EPA particulate emission standard for an incinerator of this type is 0.08 grains/dscf. The average value for this test series is 0.024 grains/dscf, or 0.125% of the allowable emission rate.)

TABLE 4

| | Metals in Flue Gas Captured by Filter | | | | |
|---|---|---|---|---|---|
| | Test 3 Sample 1 | Test 3 Sample 2 | Test 4 Sample 1 | Test 4 Sample 2 | Test 4 Sample 3 |
| Metal | | | | | |
| Silver (Ag) | <0.00003 | <0.00003 | <0.00003 | <0.00003 | <0.00003 |
| Aluminum (Al) | 0.000088 | 0.00013 | 0.00022 | 0.00035 | indeter. |
| Arsenic (As)a | <0.0003 | <0.0003 | <0.0003 | <0.0003 | <0.0003 |
| Boron (B) | 0.00029 | 0.00008 | 0.00007 | 0.00011 | indeter. |
| Barium (Ba) | <0.00003 | <0.00003 | <0.00003 | <0.00003 | <0.00003 |
| Beryllium (Be) | <.00003 | <0.00003 | <0.00003 | <0.00003 | <0.00003 |
| Calcium (Ca) | 0.0018 | 0.0011 | 0.0028 | 0.0020 | 0.0004 |
| Cadmium (Cd) | <0.00003 | <0.00003 | 0.00006 | 0.00020 | 0.00004 |
| Cobalt (Co) | <0.00003 | <0.00003 | <0.00003 | <0.00003 | 0.00006 |
| Chromium (Cr) | 0.000035 | <0.00003 | <0.00003 | <0.00003 | 0.00242 |
| Copper (Cu) | <0.00003 | <0.00003 | 0.00018 | 0.00009 | 0.00006 |
| Sodium (Na) | indeterminate | 0.0045 | 0.0099 | 0.0060 | 0.0004 |
| Iron (Fe) | 0.0259 | 0.0003 | 0.00006 | 0.00048 | 0.0104 |
| Potassium (K) | <0.01 | <0.01 | <0.01 | <0.01 | <0.01 |
| Lithium (Li) | <0.00003 | <0.00003 | <0.00003 | <0.00003 | <0.00003 |
| Magnesium (Mg) | 0.00009 | 0.00008 | 0.00014 | 0.00011 | 0.00006 |
| Manganese (Mn) | 0.00021 | <0.00003 | <0.00003 | 0.00005 | 0.00067 |
| Molybdenum (Mo) | .00003 | <0.00003 | indetermin. | <0.00003 | <0.00003 |
| Nickel (Ni) | 0.00021 | 0.00005 | 0.00004 | 0.00004 | 0.00206 |
| Lead (Pb) | <0.00015 | 0.00089 | 0.00043 | 0.00021 | 0.00015 |
| Antimony (Sb) | <0.00003 | <0.00003 | <0.00003 | <0.00003 | <0.00003 |
| Selenium (Se) | <0.00003 | <0.00003 | <0.00003 | <0.00003 | <0.00003 |
| Silicon (Si) | 0.00047 | 0.00669 | 0.00070 | 0.00051 | indeter. |
| Thorium (Th) | <0.00015 | <0.00015 | <0.000155 | <0.00015 | <0.00015 |
| Strontium (Sr) | 0.00001 | 0.00001 | 0.00001 | 0.00001 | 0.00001 |
| Vanadium (V) | <0.00003 | <0.00003 | <0.00003 | <0.00003 | <0.00003 |
| Zinc (Zn) | 0.00075 | 0.07635 | 0.00273 | 0.00105 | 0.00085 |

Dioxin (2,3,7,8-TCDD) No dioxin was detected in the flue gas during any of the sampling periods on garbage, plastics, or tire burns. The sample size for each sampling period was 20 standard cubic feet. The limit of detection ranged from 0.34 nanograms to 1.5 nanograms (or 0.02 to 0.08 nanograms per standard cubic feet of flue gas).

Data reported in milligrams per dry standard cubic feet. The incinerator (10) provides 100 percent recovery of glass char, metals and ash residue while providing a favorable stack emission.

Thus, it can be seen that at least all of the stated objectives have been achieved.

Obviously, many modifications and variations of the present invention are possible in light of the above teachings. It is therefore to be understood that, within the scope of the appended claims, the invention may be practised otherwise than as specifically described.

We claim:

1. A municipal waste incinerator, comprising:

a primary combustion chamber for receiving waste materials to be burned to yield combustion gases;

means for transporting said combustion gases to a secondary combustion unit for re-igniting the combustion gases;

said secondary combustion unit including a chamber having a bottom feed opening for receiving the combustion gases, a top exhaust opening, and an intermediate choke and air mixing section;

an air mixing means disposed in said air mixing section for supplying outside air from a plurality of points around the periphery of the air mixing section, and being directed toward the center thereof;

means for forming a flue gas cone having an upwardly directed apex, said cone forming means including said intermediate choke and said air-mixing means; and a plurality of re-ignition burners disposed around the periphery of said air mixing section and being disposed immediately above said air mixing means at the apex of the flue gas cone, each of said burners being disposed such that a flame extending therefrom is directed about 30° degrees off of center of the air mixing section, whereby the flames extending from the burners form a vortex to assist in the mixing and complete burning of the combustion gases before they exit the top exhaust opening.

2. The incinerator of claim 1, wherein said secondary combustion unit further includes an enlarged accumulation chamber disposed intermediate said bottom feed opening and said air mixing section, whereby flow to the burners is uninterrupted by fluctuations in the volume of combustion gases entering the secondary unit.

3. The incinerator of claim 1 wherein said secondary combustion unit further includes an enlarged expansion chamber disposed intermediate said air mixing section and said top exhaust opening, whereby controlled residence time of the combustion gases at high temperature is provided.

4. The incinerator of claim 1 wherein said primary combustion chamber is selectively sealable to provide for air-starved combustion of the waste material.

5. The incinerator of claim 1 wherein said combustion gas transporting means includes a transfer tube attached to and interconnecting said primary combustion chamber and said secondary combustion unit.

6. The incinerator of claim 5 wherein a damper is disposed within said transfer tube to control the flow of combustion gases to the secondary combustion unit.

7. The incinerator of claim 1 wherein said chamber of said secondary combustion unit is circular in cross-section.

8. The incinerator of claim 4 wherein said primary combustion chamber includes a top access door and a bottom access door.

9. The incinerator of claim 8 wherein said primary combustion chamber is circular and includes a floor disposed to slope downwardly to a central solids discharge opening, and wherein said bottom access door is selectively movable between an open and closed position.

10. A minicipal waste incinerator, comprising:

a primary combustion chamber for receiving waste materials to be burned to yield combustion gases, said primary combustion chamber being selectively sealable to provide for air-starved combustion of the waste material and including a top access door and a bottom access door, said primary combustion chamber being circular and including a floor disposed to slope downwardly to a central solids discharge opening , and wherein said bottom access door is selectively movable between an open and closed position;

means for transporting said combustion gases to a secondary combustion unit for re-igniting the combustion gases;

said secondary combustion unit including a chamber having a bottom feed opening for receiving the combustion gases, a top exhaust opening, and an intermediate choke and air mixing section;

an air mixing means disposed in said air mixing section for supplying outside from a plurality of points around the periphery of the air mixing section, and being directed toward the center thereof;

a plurality of re-ignition burners disposed around the periphery of said air mixing section immediately above said air mixing means, each of said burners being disposed such that a flame extending therefrom is directed about 30° degrees off of center of the air mixing section, whereby the flames extending from the burners form a vortex to assist in the mixing and complete burning of the combustion gases before they exit the top exhaust opening; and a sloping screen disposed below said bottom access door, a fines conveyor disposed below said screen, and a sorting conveyor disposed adjacent one end of said screen whereby uncombusted solid materials discharged from the primary combustion chamber are separated for further processing.

* * * * *